United States Patent [19]

Downie et al.

[11] Patent Number: 5,019,455

[45] Date of Patent: May 28, 1991

[54] SOW MOLD AND SOW INGOT

[75] Inventors: Robert Downie; Ray D. Peterson; Nolan E. Richards; Roger D. White, all of Lauderdale County, Ala.

[73] Assignee: Reynolds Metal Company, Richmond, Va.

[21] Appl. No.: 428,525

[22] Filed: Oct. 30, 1989

[51] Int. Cl.[5] ..... B22D 3/00; B22D 7/06

[52] U.S. Cl. ..... 428/584; 428/577; 428/583; 249/174

[58] Field of Search ..... 249/174, 135; 428/577, 428/582, 583, 584, 585, 588, 600

[56] References Cited

U.S. PATENT DOCUMENTS

| | | | |
|---|---|---|---|
| 2,146,678 | 2/1939 | Jung | 428/600 X |
| 2,157,097 | 5/1939 | Jung | 428/582 X |
| 3,007,586 | 11/1961 | Bressler | 428/582 X |
| 3,017,042 | 1/1962 | Bertram et al. | 428/582 |
| 3,352,648 | 11/1967 | Harper et al. | 428/582 |
| 3,671,204 | 6/1972 | Foley et al. | 428/582 |
| 4,527,779 | 7/1985 | Roth et al. . | |
| 4,578,111 | 3/1986 | Gillespie et al. . | |
| 4,581,063 | 4/1986 | Oyabu et al. . | |
| 4,741,382 | 5/1988 | Andre et al. . | |

FOREIGN PATENT DOCUMENTS

| | | | |
|---|---|---|---|
| 2579119 | 9/1986 | France . | |
| 52-53725 | 4/1977 | Japan | 164/DIG. 6 |

*Primary Examiner*—Richard K. Seidel

*Assistant Examiner*—J. Reed Batten, Jr.

*Attorney, Agent, or Firm*—Alan M. Biddison

[57] ABSTRACT

A mold for the casting of aluminum sow ingots includes a mold box having a bottom wall and side walls that define a generally rectangular mold cavity. The bottom wall includes a central raised longitudinally extending protrusion and side longitudinally extending protrusions adapted to define corresponding depressions in the ingot bottom. The side depressions establish ledges for receiving a pair of fork lift blades or tines entering the ledges from either transverse side of the ingot perpendicular to the ledges. A pair of transversely extending protrusions in the mold bottom wall establish corresponding transverse depressions in the mold bottom that are perpendicular to the central longitudinal depression and equispaced from the central transverse axis by a distance enabling the pair of fork lift blades to enter the transverse depressions from a direction perpendicular to either of the longitudinally extending ingot sides to provide a dual entry feature for ease of handling. The depressions in the ingot bottom also define a surface to volume ratio enabling a solidification front in the molten metal to occur that moves from the ingot bottom surface to the top surface to significantly reduce formation of voids in the ingot and depression of the top surface. The sow ingot cast has depressions in its bottom surface that facilitate solidfication and stacking of the ingot.

21 Claims, 5 Drawing Sheets

SOW MOLD AND SOW INGOT

TECHNICAL FIELD

The present invention relates generally to the design of pig/sow molds for the production of sow ingots used, for example, in the aluminum industry. More particularly, the present invention relates to a unique shape of a low profile sow mold that enables molten ingot metal to cool and solidify at an enhanced cooling rate to produce a sow ingot which is substantially free of internal voids and cracks and formed with an arrangement of concavities in a bottom thereof to permit handling by forklift from any one of four sides of the ingot. The ingot also can be handled by any other mechanical, electrical or electronic lifting device.

BACKGROUND ART

Generally speaking, there are two major types of sow ingots sold in the aluminum industry today. The first type is the "traditional" sow ingot and the second type is the "low profile" sow which is gaining wide acceptance within the aluminum industry.

Prior art FIGS. 1A and 1B are illustrations of a traditional sow ingot 10 which typically weighs approximately 1200 pounds and resembles an inverted truncated pyramid. The sow 10 is square in plan view (FIG. 1B), usually has a depth D approximately ½ the maximum width W, and is formed by pouring molten ingot metal into a mold 20 having a bottom wall 21 and four sloping side walls 21*a*–21*d* defining a mold cavity 23. This ingot shape causes a number of problems, generally related to the manner in which the sow solidifies in the sow mold. Specifically, the shape of mold 20 (FIGS. 1C and 1D) causes the ingot to solidify lastly in the interior center region 12, creating two problems. First, the upper surface 14 of the ingot 10 draws down as the metal solidifies and shrinks. Since the sides 15 solidify first, the outer, upper edges 16 are fixed at a relatively high level 17. The central portion 18 of the upper surface 14 then pulls or draws down during solidification to create an undesirable, deeper central depression on the upper surface.

A second drawback is that once the upper surface solidifies, molten metal is trapped within the interior regions of the ingot. Molten metal has a solubility for hydrogen gas of about 0.20 to 0.50 cubic centimeters per 100 grams of metal depending upon temperature. The hydrogen solubility of the solidified aluminum exterior is almost zero. Consequently, if the interior molten zone is sealed from the external environment by the solidified material, a void 19 will tend to form when the hydrogen is expelled from the solidifying metal. Measurements of 1200 pounds sow ingots of the type depicted in FIGS. 1A and 1B have revealed voids 19 that measure as large as 12×12 inches by 2 inches thick. If the gas pressure of the entrapped hydrogen within the void 19 is large enough, the overlying solidified metal may be ruptured and this rupture can cause cracks extending from the void to the ingot upper surface 14. The combination of the depression 18, the cracks (not shown) and the voids 19 can be a severe safety problem since water from rain or other sources may become trapped inside the sow ingot, particularly when the sows are stacked outdoors prior to being transferred to a furnace for re-melting. To avoid charging wet sow ingots into the furnace, the sows are typically stored and dried in an indoor staging area, entailing extra handling.

The sow ingots are typically stacked in a storage location or staging area prior to delivery to a furnace and are usually handled by a fork truck having a pair of fork lifts 25 adapted to engage the recessed edges 22 of the square bottom 24 of the ingot. These recessed edges 22 formed along the four bottom edges of the ingot allow a fork truck to engage the stack from any side for ease of handling and stacking. However, the upper surface depression 18 contributes to instability of a stack of sow ingots since the depressions tend to cause the individual ingots to become off-balance in relation to each other when the bottom surface 24 of an above in-line ingot does not properly contact the upper depressed surface 14 of the adjacent below ingot in the stack.

The newer low profile sow ingots are designed to avoid the formation of a large, entrapped molten interior zone during the solidification process. These sows typically weigh about 1500 to 2000 pounds. The height of these sows is much lower than the traditional sows of FIG. 1A and 1B. Consequently, to cast the same amount of metal in the low profile sow as compared to the sow of FIG. 1A, the base area of the ingot is increased by utilizing a low profile mold having an elongate rectangular base. The low profile sow also includes side "wings" or extensions projecting above the base that promote heat loss and increase the sow ingot volume without increasing depth. In comparison with the prior art sow of FIG. 1A, the low profile sow ingot is a safer product since it reduces chances of water infiltration and stacks better due to the flatter upper surface. However, the presence of internal voids and a slightly depressed upper surface can still exist, albeit to a lesser extent than in the sows of FIG. 1A.

Another major drawback of the previously known low profile sow relates to difficulty in handling. Specifically, a fork lift truck can only pick up such ingot from one of two short sides, limiting access possibilities when storing, when positioning for shipping, or when moving for remelting.

It is accordingly one object of the present invention to provide a low profile sow mold design having enhanced cooling rates and improved solidification characteristics that promotes a solidification front in the sow ingot which moves from the bottom to the top by enhancing heat transfer capability in the bottom.

Another object of the invention is to provide an improved low profile sow ingot and sow mold design therefor preventing or reducing the possibility of initial solidification occurring in the upper surface of the ingot to thereby decrease the potential of internal voids and upper surface depressions in the ingot.

Another object of the invention is to provide a unique sow ingot and sow mold design formed with a unique arrangement of depressions or concavities in the sow ingot bottom that correspond to depressions or concavities in the bottom of the sow mold and are positioned to receive and nest upon a pair of fork lift tines entering the associated depressions or concavities from any of the four sides of the ingot.

SUMMARY OF THE INVENTION

A mold for casting molten metal into ingots, in accordance with the present invention, comprises a mold box having a bottom wall and upwardly extending side walls defining a mold cavity for receiving molten metal.

The bottom wall includes a first raised zone projecting into the cavity and which extends longitudinally along the length of the bottom wall. The first raised zone is adapted to form a longitudinal depression of corresponding cross section in a bottom surface of the ingot. At least one second raised zone projects into the cavity and extends transversely along the width of the bottom wall to form a transverse depression of corresponding cross section in the ingot bottom surface.

The first and second raised zones are advantageously configured to define an ingot bottom surface to volume ratio enabling a solidification front in the molten metal to occur that moves from the bottom surface to a top surface of the ingot to substantially entirely prevent formation of voids in the ingot and depression of the top surface that would otherwise prevent proper stacking of the ingots.

In a preferred embodiment of the invention, the first raised zone extends along the central longitudinal axis of the mold cavity bottom wall in the form of a central raised ridge or protrusion. A pair of second raised zones are preferably provided in the form of a raised ridge or protrusion extending generally perpendicular to the central longitudinal protrusion and on opposite sides of a central transverse axis of the mold bottom wall. The second raised protrusions define second raised depressions in the ingot communicating with opposing longitudinal sides of the ingot. The second raised depressions are spaced from each other to receive a pair of fork lift tines entering these depressions from directions perpendicular to either of the ingot longitudinal sides for ease of entry and handling.

In accordance with another preferred feature of the invention, longitudinally extending edges of the mold bottom wall which extend contiguous with the opposing longitudinal side walls respectively define a pair of third raised zones establishing third raised depressions in the ingot bottom. The third raised depressions form side ledges in the ingot bottom which are spaced from each other on opposite sides of the central longitudinal axis a distance sufficient to receive a pair of fork lift tines entering the third raised depressions from a direction perpendicular to either of the transverse sides of the ingot. The arrangement of longitudinally extending side ledges and transversely extending second raised depressions in the ingot bottom, arranged in mutually perpendicular directions, advantageously enable the ingot or a stack thereof to be easily handled with a fork lift irrespective of the stacking orientation. These depressions thereby establish a dual or multiple entry feature for ease of access when storing or positioning the ingots for shipping.

It is a preferred feature of the invention to form the central longitudinal ridge and the pair of longitudinally extending raised bottom edges (i.e., third raised zones) in the mold to establish the central longitudinal depression and the side ledges extending into the ingot bottom a distance at least as high as 25% of the ingot height. Preferably, the central longitudinal ridge extends at least 50% of the ingot length to promote the "bottom to top" solidification front. The raised side ledges preferably comprise at least 43% of the ingot width to promote the aforesaid solidification characteristics.

The length to width ratio of the ingot is preferably about 1.6 to 1.0 and a preferred height to length ratio is about 0.2 to 1 or less. In combination with the above specified height, length and width characteristics of the various raised zones, the resulting low profile ingot with the preferred embodiments is characterized by a solidification front which generally moves from the bottom to the top to minimize the occurrence of internal voids and reduce upper surface depression while enhancing the cooling rate of the molten metal for faster solidification and thereby increased production throughput.

Other objects, features and advantages of the present invention will become apparent upon reading the following specification and claims when taken in conjunction with the accompanying drawings.

BEST MODE FOR CARRYING OUT THE INVENTION

Figure 7:
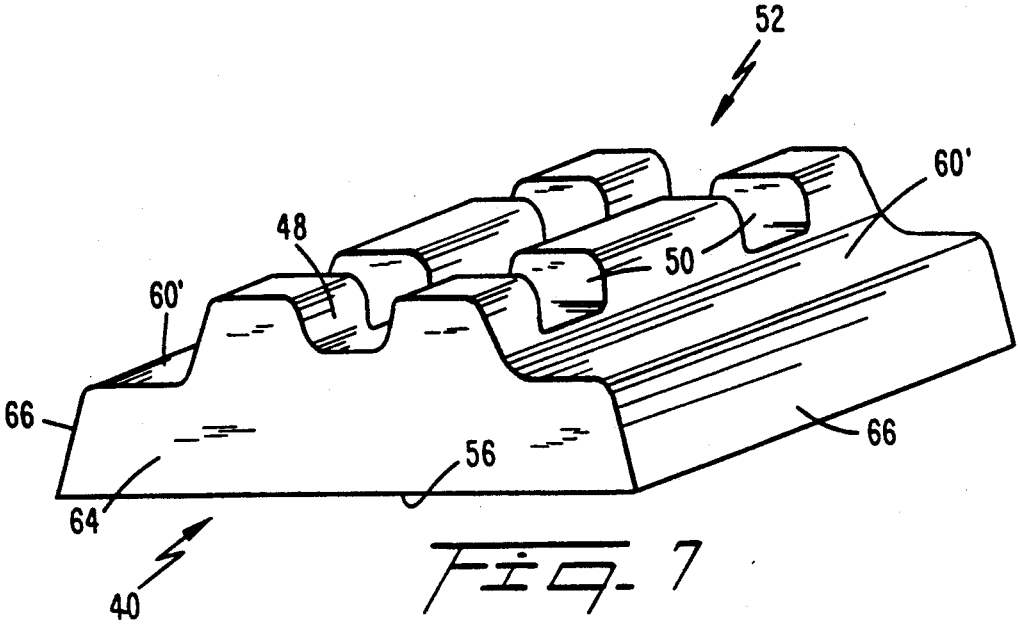
FIGS. 7 and 8 are perspective views of an inverted sow ingot formed with the mold of FIGS. 2–6.
Figure 8:
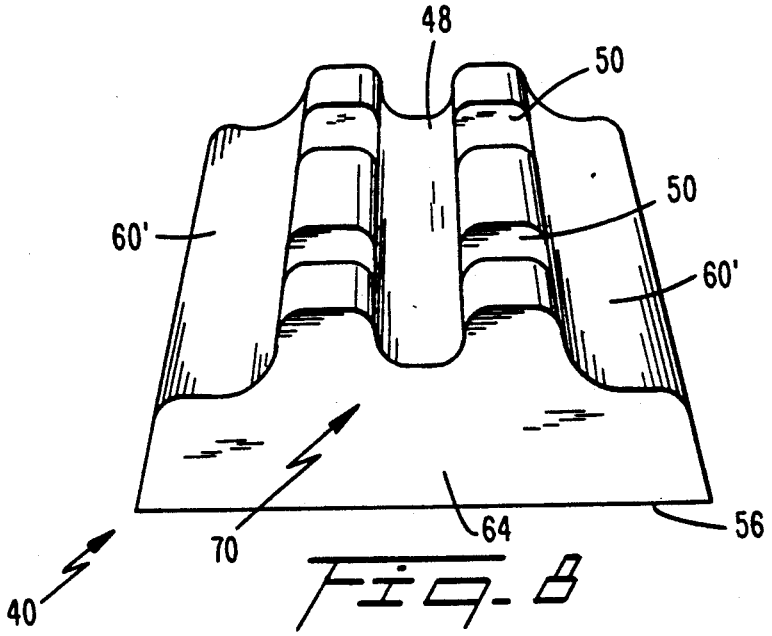

FIGS. 2–6 are engineering, scaled drawings of a sow ingot mold 30 in accordance with a preferred embodiment of the present invention. FIGS. 7 and 8 depict an ingot 40 formed with the mold 30 schematically illustrated in FIGS. 2–6. The ingot 40 has been inverted to facilitate illustration of its bottom surface 52.

In accordance with the unique features described below, mold 30 includes a bottom wall 32 and side walls 34 and 36 shaped for the casting of a novel type of rectangular aluminum ingot 40 depicted in FIGS. 7 and 8. As will be seen, aluminum ingot 40 is shaped to permit ease of handling by fork lift irrespective of stacking direction. Additionally, the unique shape of mold 30 enables solidification of the molten metal to occur at enhanced cooling rates, and by means of a "bottom to top" solidification front that reduces the formation of internal voids, casting cracks and depression of the top surface of the ingot 40 (which would result in undesirable imbalance in stack arrangement). This in turn prevents the accumulation of cooling water (or rain during outdoor stacking) in the ingots 40 that can subsequently cause problems in remelting (e.g. furnace explosion). Thus, in some cases it might be possible to eliminate the need to pre-heat ingots 40 in a pre-heat furnace to remove this water prior to re-melting, or to transfer the ingots to an in-door staging area.

Mold 30, preferably of rectangular configuration in plan view (FIG. 2), comprises the bottom wall 32, a pair of longitudinally extending side walls 34 and a pair of transversely extending side walls 36 integrally formed or connected to define a mold cavity 38 into which molten metal such as aluminum is poured in a conventional manner. The bottom wall 32 and side walls 34, 36 are preferably of the same uniform thickness (e.g. 3 inches) and manufactured, for example, of ductile iron.

To obtain the desired "bottom to top" solidification front characteristics, an important feature of the present invention is the provision in bottom wall 32 of a longitudinally extending raised protuberance, zone or a ridge 42 and at least one and preferably two transversely extending raised protuberances, zones or ridges 44 and 46. The ridge 42 may be symmetrical about a central longitudinal axis 45 whereas the transverse raised protuberances 44, 46 are preferably equispaced from a central transverse axis 47. The peaks of ridges 42, 44 and 46 in the mold cavity interior are preferably flat or convex surfaces and the intersections 49 between the longitudinal and transverse ridges, in top plan view (FIG. 2), are preferably concave for ease of removal of the solidified ingot from the mold cavity 38.

The central and transverse raised ridges or protuberances 42,44,46 projecting upwardly from the mold bottom wall 32 advantageously form a corresponding set of longitudinal (48) and transversely extending depressions or concavities (50) in the bottom 52 of the sow ingot 40. As the mold bottom wall 32 is preferably of uniform thickness, associated depressions or concavities 48',50, are also formed in the bottom surface 54 of the mold 30 underlying the ridges 42, 44 and 46 in the top surface of the bottom wall. The depressions or concavities 48,50 in the ingot 40 as well as the corresponding depressions or cavities 48',50, in the mold bottom surface 54 advantageously enhance "bottom to top" solidification by increasing the mold bottom surface area to volume ratio, and also by decreasing the distance between portions of the ingot top surface 56 overlying the ridges 42, 44 and 46 and the sow interior, thereby diminishing the likelihood of forming voids in the sow ingot and depressions in the top surface 56 thereof. Additionally, the enhanced cooling rates enable the sow ingot 40 of the present invention to solidify faster than conventional low profile ingots of the same weight formed without the depressions and concavities 48,50 in the ingot of the present invention.

As a result of experimentation, it was determined that the average number of seconds required for one pound of molten metal to solidify was approximately 0.81 seconds for an ingot 40 having a metal weight of 1775 pounds and formed in the mold 30 of the present invention having proportional dimensions as set forth below. A traditional ingot having a metal weight of 1095 pounds required approximately 3.41 seconds for each pound of metal to solidify. Using the conventional low profile molds having substantially the same rectangular dimensions as the mold of the present invention but without the central and transversely extending ridges in the bottom wall thereof as in the present invention, a 1515 pound ingot required 1.13 seconds per pound of metal and ingots of 1900 and 2000 pounds weight required 1.52 and 1.50 seconds per pound of metal, respectively. Thus, the feature of providing the longitudinal and transversely extending depressions in the ingot 40 of the present invention enables the ingots to solidify faster at enhanced cooling rates, resulting in faster processing than the conventional low profile sows of the same weight. It should be appreciated that solidification rates are a function of numerous factors, such as the temperature of the mold, metal temperature, pour rates, and the alloy being cast.

Figure 1C:
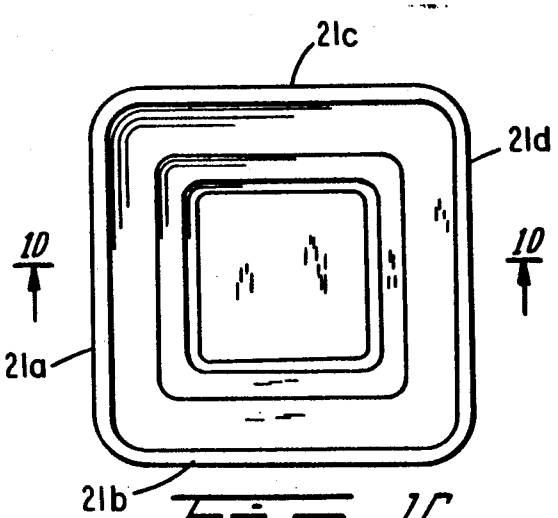
FIG. 1C (PRIOR ART)
FIG. 1C is a top plan view of a prior art sow ingot mold used to cast the sow ingot of FIGS. 1A and 1B.
Figure 1D:
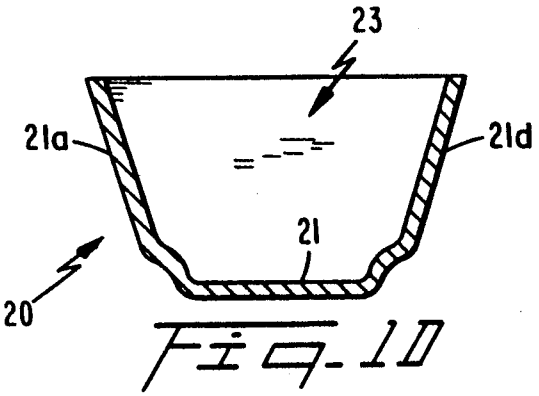
FIG. 1D (PRIOR ART)
FIG. 1D is a sectional view taken the line 1D—1D of FIG. 1C.
Figure 1A:
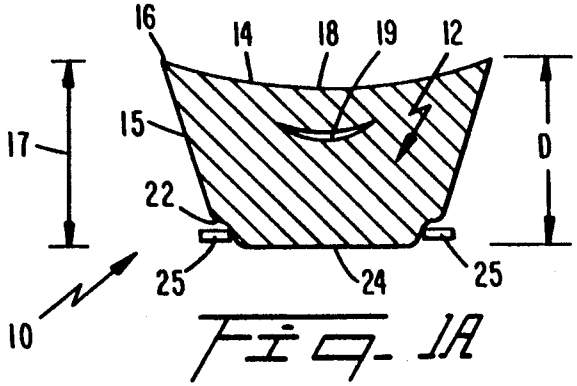
FIG. 1A (PRIOR ART)
FIG. 1A is a sectional view of a prior art sow ingot taken along the line 1A–1A of FIG. 1B.
Figure 1B:
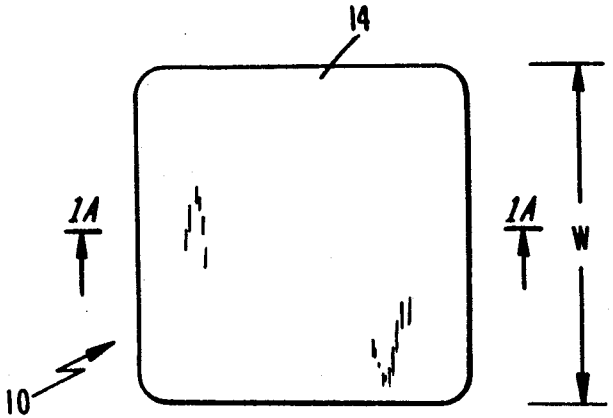
FIG. 1B (PRIOR ART)
FIG. 1B is a top plan view of the prior art sow ingot of FIG. 1A.
Figure 2:
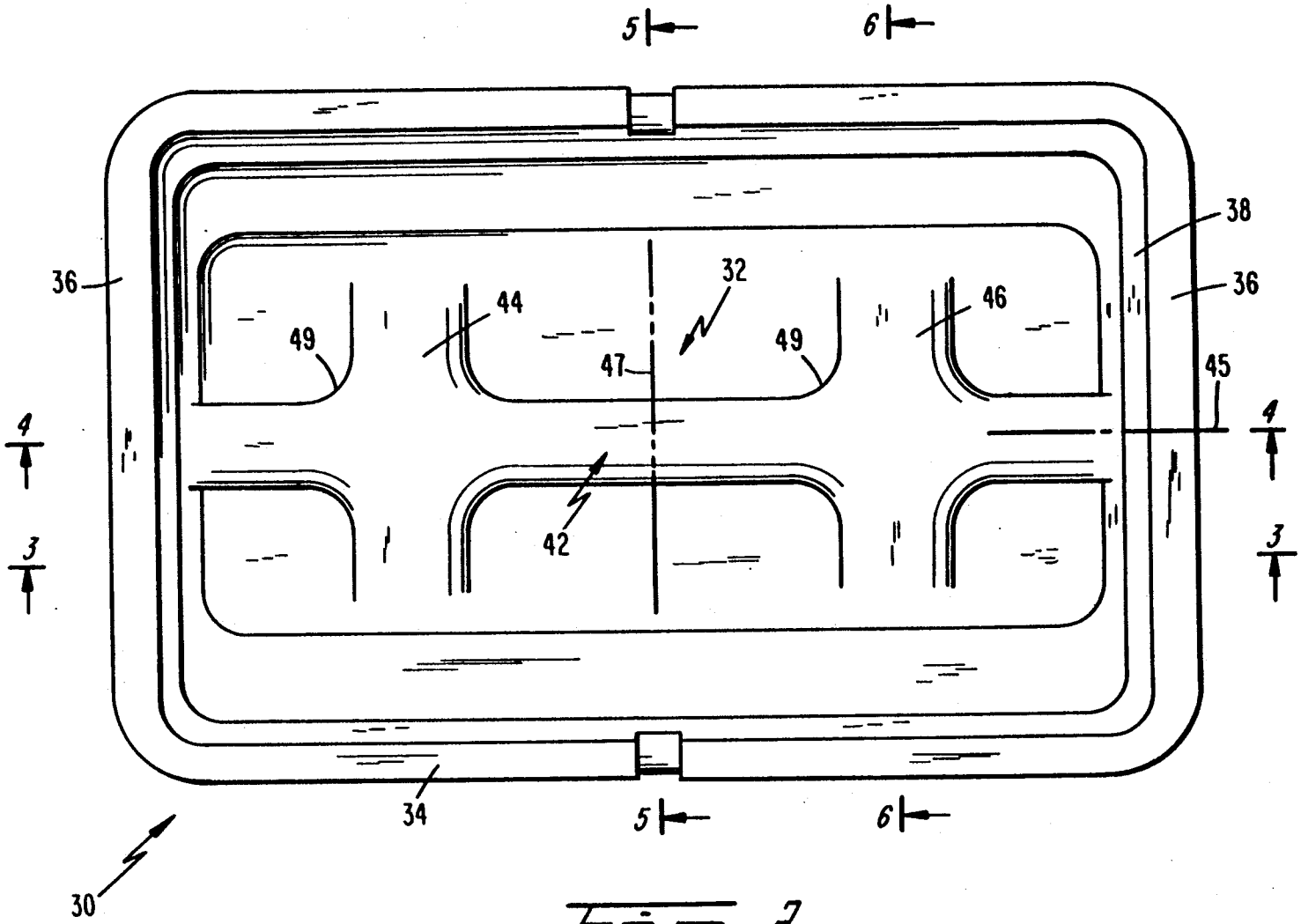
FIG. 2 is a top plan view of a low profile of a sow ingot mold in accordance with a preferred embodiment of the present invention.

The pair of transversely extending ridges 44,46 in the sow mold 30 and correspondingly formed depressions 50 in the ingot 40 are advantageously spaced from each other by a distance equal to the distance between a pair of fork truck tines 25 of the type depicted in prior art FIG. 1A. Furthermore, with reference to FIGS. 5 and 6, the longitudinally extending edges 58 of the mold bottom wall 32 extending contiguous with the opposing longitudinal side walls 34 of the mold 30 define a pair of third raised zones 60 (relative to the depressions 62 formed in either side of the central ridge 42 in the upper surface of the mold bottom wall) that establish raised longitudinally extending depressions 60, (FIGS. 7 and 8) in the bottom surface of the ingot 40. These depressions 62 are spaced from each other on opposite sides of the central longitudinal ingot axis to advantageously define a pair of raised side ledges in the ingot spaced a distance apart to receive the pair of fork lift tines 25 entering the raised depressions from a direction generally perpendicular to one of the transverse ingot sides 64. In this manner, it will be appreciated that the sow ingots 40 of the present invention are provided with a dual entry feature allowing the fork lift tines 25 to pick up the ingot from any one of the four sides, i.e., transverse sides 64 and longitudinal sides 66. This makes it easier for the fork truck operator to lift and place the sow ingots in any desired location.

Figure 3:
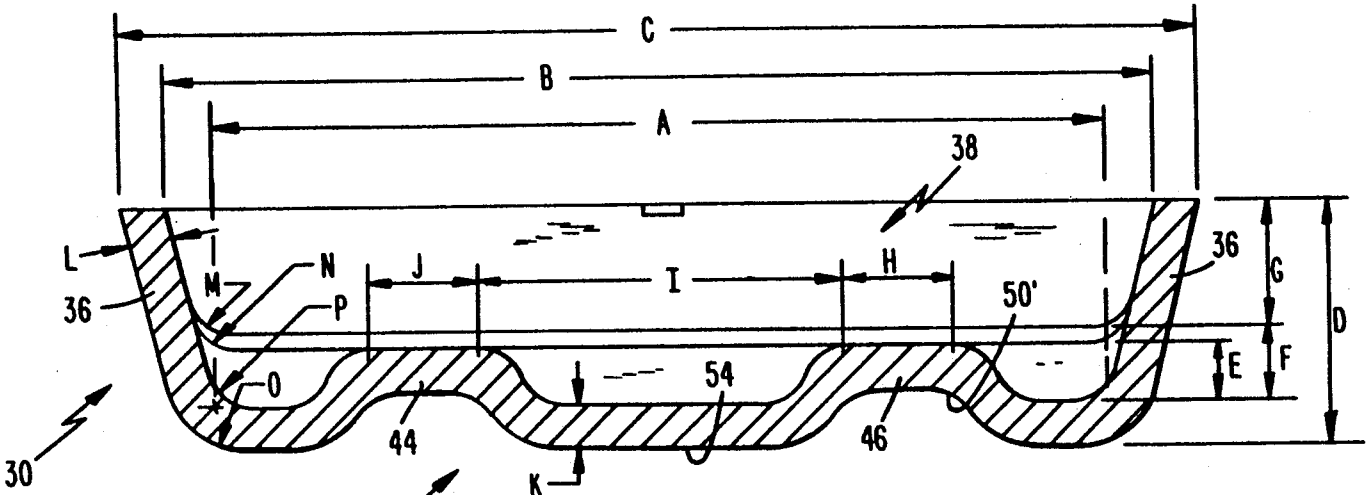
FIG. 3 is a sectional view taken along the line 3—3 of FIG. 2.
Figure 4:
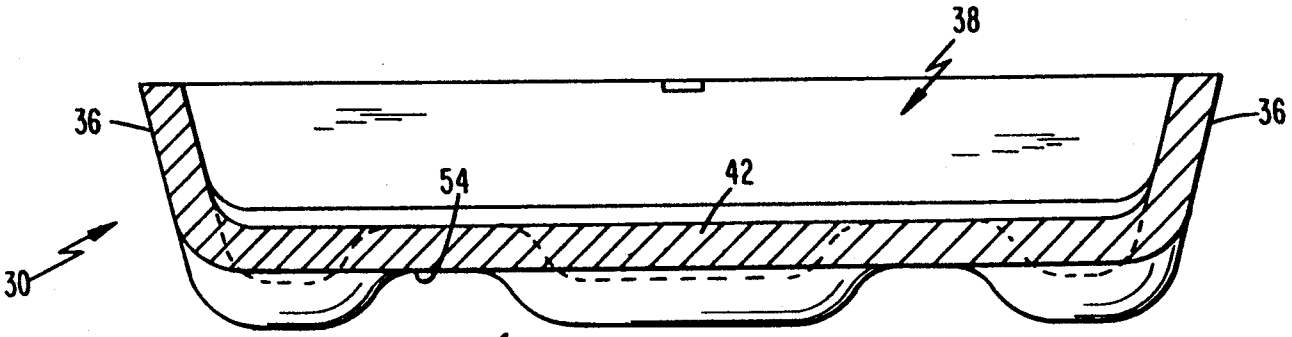
FIG. 4 is a sectional view taken along the line 4—4 of FIG. 2 extending through the central longitudinal axis of the mold.
Figure 5:
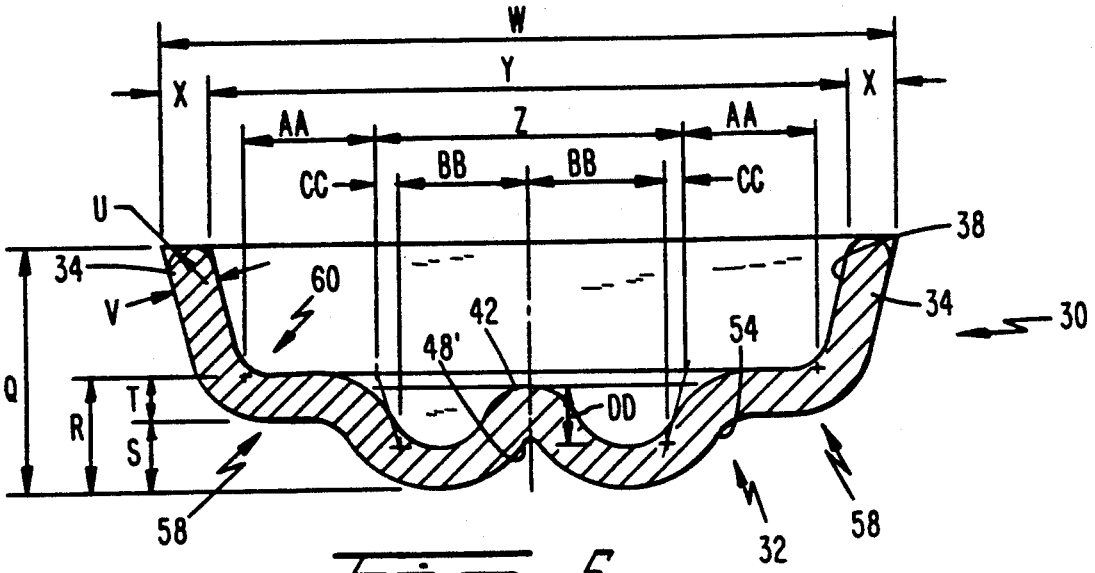
FIG. 5 is a sectional view taken along the line 5—5 of FIG. 2 extending through the central transverse axis of the mold.
Figure 6:
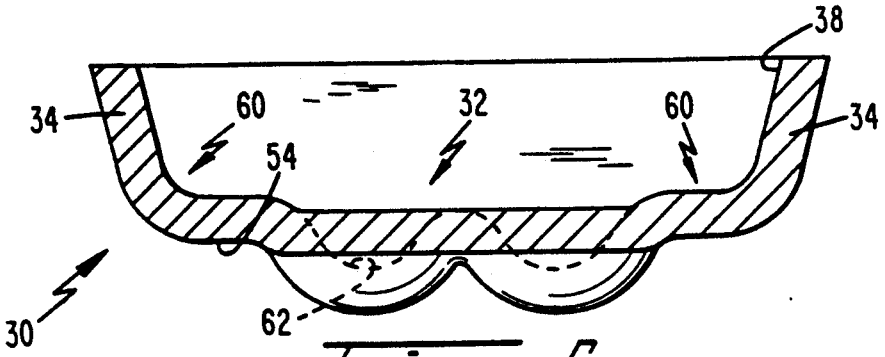
FIG. 6 is a sectional view taken along the line 6—6 of FIG. 2.

According to an illustrative example, with reference to FIGS. 3 and 5, the sow ingot mold 30 of the present invention may be provided with the following nominal dimensions:

| Sow Ingot Mold | |
|---|---|
| Nominal Dimensions = | 76 by 49⅛ by 17 inches |
| Actual A = | 62⅞ inches |
| Actual B = | 69¾ inches |
| Actual C = | 76 inches |
| Actual D = | 17 inches |
| Actual E = | 4 inches |
| Actual F = | 5 inches |
| Actual G = | 9 inches |
| Actual H = | 8 inches |
| Actual I = | 25 inches |
| Actual J = | 8 inches |
| Actual K = | 3 inches |
| Actual L = | 3 inches |
| Actual M = | 3 inch radius of curvature |
| Actual N = | 3 inch radius of curvature |
| Actual O = | 6 inch radius of curvature |
| Actual P = | 3 inch radius of curvature |
| Actual Q = | 17 inches |
| Actual R = | 8 inches |
| Actual S = | 5 inches |
| Actual T = | 3 inches |
| Actual U = | 1½ inch radius of curvature |
| Actual V = | 3 inches |
| Actual W = | 49⅛ inches |
| Actual X = | 3 1/16 inches |
| Actual Y = | 42 15/16 inches |
| Actual Z = | 20½ inches |
| Actual AA = | 9 inches |
| Actual BB = | 9 inches |
| Actual CC = | 1¼ inches |

The foregoing nominal dimensions of sow ingot mold 30 may be utilized to form a sow ingot 40 having a weight of approximately 2000 pounds. The dimensions are illustrative and may be varied somewhat as will occur to one of ordinary skill in the art based upon this specification. However, certain relationships between various dimensions of the sow ingot mold are desirable in order to obtain the maximum advantages of the invention. Thus, it is a feature of the invention that the height of the central raised longitudinal depression 48 and transversely extending depressions 50 the sow ingot 40 defined by reference characters DD and E, respectively, be at least as high as 25% of the height of the sow ingot defined by dimensions G+F. Furthermore, the combination of the areas of the bottom surface occupied by the central longitudinal ridge 42 and the pair of transversely extending ridges 44,46 in the bottom surface of the sow ingot 40 is equal to at least 40% and preferably at least 50% of the total area of the bottom surface of the sow ingot as defined by the dimensions "A" by "Z". The width of the raised side ledges 60, in the sow ingot 40 defined by dimensions AA should comprise at least 43% of the total width (defined by dimension Y) of the soe ingot. In addition, the length (dimension C) to width (dimension Y) of the sow ingot should be approximately 1.6 to 1, while the height (dimensions F+G) to length (dimension B) ratio of the sow ingot should be 0.2 to 1 or less.

As mentioned briefly above, the intersections 49 between the central and transversely extending ridges 42,44,46 in the mold bottom wall 32 are preferably smoothly concave and generally arch shaped, however, other shapes may be provided that would not cause the ingot to stick to the mold during solidification and shrinkage.

The sow ingot and mold in accordance with the present invention have a number of advantages over the low profile molds discussed above and the prior art molds of FIGS. 1A–1D. For example, better heat loss out of the central sow ingot region 70 occurs in the present invention due to both the low profile and the concavities formed by the longitudinal and transversely extending ridges 42,44,46 in the mold bottom wall. This results in reduced formation of voids, or the prevention thereof, in the ingot interior and a greater tendency for the top surface 56 of the ingot to be formed as a flat upper surface. This, in turn, results in a safer sow ingot both in stacking and in avoiding trapping of water. The improved heat loss discussed above will also result in a faster cool down or solidification period of the ingot for a given metal weight.

The flatter topped surfaces 56 of the ingot 40 promote easier stacking. The dual entry feature discussed above allows the tines 25 of the fork lift to pick up the ingot from any of the four sides, making it easier for the fork truck operator to lift and place ingots in any desired location.

Furthermore, the mold 30 of the present invention lends itself to higher pouring weights. In other words, due to the enhanced cooling rates, the sow ingot mold of the present invention can easily handle a 2000 pound capacity. Further, higher pouring rates increase productivity on a per pound basis. For example, one mold would provide more pounds of aluminum in ingot form than the conventional low profile molds before the mold would have to be changed since the mold life is dependent on the total number of pours or cycles. In addition, higher pouring rates make it possible to cast more metal in a given period of time, such as during one operating shift. More molds of a given size can be filled during such shift.

The sow ingots 40 of the present invention should also lend themselves to faster heat up and melt down in melting furnaces in comparison with the conventional low profile sow ingots discussed above. The sow ingot of the invention will have a higher rate of heat transfer into its mass than conventional low profile sows of equal weight due to its increased bottom surface area to volume ratio and due to the bottom concavities 48,50 and side ledges 60' which allow heat to reach the normally blocked sow underside as occurs during stacking or charging of sows into a furnace.

Another series of tests confirmed that the molds of the present invention, when compared with conventional molds for casting 1000 pound ingots, produced better ingots in terms of void suppression, vertical cracking suppression, upper surface flatness, ease of stacking, and overall appearance. The tests also revealed that it is still possible when using the inventive molds to make sow ingots with internal voids. However, even when proper casting practices are not followed, the molds of the present invention still produced better ingots than conventional molds.

During one test conducted by casting metal at 1610° F. into cold molds, an ingot cast in a conventional 1000 pound mold had a two inch depression in the upper surface and two small internal voids. A 1782 pound ingot cast in a nominal 1500 pound mold according to the present invention had a 0.5 inch surface depression and a 1858 pound ingot cast in an inventive 2000 pound mold had a one inch surface depression. No internal voids were detected in either ingot.

The ingots cast with the inventive molds were ready to be pulled 52 minutes after pouring, while the ingot cast with the conventional mold was still molten in the top center region. Ninety minutes would normally be required for solidification of an ingot of this type. The ingots were removed from the molds by placing conventional aluminum lifting rings in the molten metal in the molds that solidified in place. Lifting wedges, if desired, could have been used instead of the rings.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A mold for casting a molten metal into a metal ingot, comprising a mold box having a bottom wall and side walls projecting upward from the bottom wall to define a mold cavity therewith for receiving said molten metal, said bottom wall including a first raised zone projecting into the cavity and extending longitudinally along the length direction of the bottom wall and adapted to form a longitudinal depression of corresponding cross section into a bottom surface of the ingot formed therein, and at least two second raised zones projecting into the cavity and extending transversely along the width of the bottom wall and adapted to form respective transverse depressions of corresponding cross section in a bottom surface of the ingot, wherein said second raised zones define raised depressions in the ingot bottom communnicating with opposing longitudinal sides of the ingot and which raised depressions are spaced from each other to receive a pair of fork lift tines entering said depressions from a direction generally perpendicular to one of the opposing longitudinal ingot sides for ease of handling;

2. The mold of claim 1, wherein said first and second raised zones are configured to define an ingot bottom surface to volume ratio enabling a solidification front in the molten metal to occur that moves from the bottom surface of the ingot which is in intimate contact with the mold bottom wall and the first and second raised zones to a top surface of the ingot to substantially prevent formation of voids in the ingot and depression of the top surface of the ingot.

3. The mold of claim 1, wherein said first raised zone extends along the central longitudinal axis of the bottom wall in the form of a central raised ridge or protrusion, and said second raised zones are each inn the form of a raised ridge of protrusion extending generally perpendicular to the first raised zone on opposite sides of a central transvserse axis of the mold bottom wall.

4. The mold of claim 3, wherein the central raised ridge is configurred such that the height of the longitudinal depression in the ingot is at least about 25% of the ingot height.

5. The mold of claim 33, wherein said central raised ridge extends at least 50% of the length of the bottom wall.

6. The mold of claim 1, wherein the length to width ratio of the ingot formed in said mold is approximately 1.6 to 1.0 and the height to length ratio is not greater than approximately 0.2 to 1.0

7. A mold for casting a molten metal into a metal ingot, comprising a mold box having a bottom wall and side walls projecting upward from the bottom wall to define a mold cavity therewith for receiving said molten metal, said bottom wall including a first raised zone projecting into the cavity and extending longitudinally along the length direction of the bottom wall and adapted to form longitudinal depression of corresponding cross section into a bottom surface of the ingot formed therein, and at least two second raised zones projecting into the cavity and extending transversely along the width direction of the bottom wall and adapted to form a transvserse depression of corresponding cross section in a bottom surface of the ingot, wherein said second raised zones define raised depressions in the ingot bottom communnicating with opposing longitudinal sides of the ingot and which raised depressions are spaced from each other to receive a pair of fork lift tines entering said depressions from a direction generally perpendicular to one of the opposing longitudinal ingot sides for ease of handling and wherein longitudinally extending edges of the mold bottom wall extending contiguous with the opposing mold side walls respectively define a pair of third raised zones establishing raised protuberances in the mold bottom wall spaced from each other on opposite sides of the central longitudinal axis to define a pair of longitudinally extending raised side ledges in the ingot bottom adapted to receive a pair of fork lift tines entering beneath the ledges from a direction generally perpendicular to one of the ingot transvserse sides.

8. The mold of claim 7, wherein longitudinal axes of said second raised zones are equispaced from the central transvserse axis.

9. The mold of claim 8, wherein said central raised ridge extends substantially the entire length of the mold bottom wall.

10. The mold of claim 9, wherein the upper surface of the mold bottom wall includes depressed regions in the bottom wall within the mold cavity disposed between said first and second raised zones.

11. The mold of claim 10, wherein surfaces of said depressed regions in the mold cavity are generally coplanar with each other.

12. The mold of claim 7, wherein the width of the raised side ledges of the ingot is about at least 43% of the total width of the ingot.

13. In a sow ingot cast from a molten metal, the improvement comprising a bottom surface of the ingot including a longitudinally extending depression and at least two transversely extending depressions configured to define an ingot bottom surface to volume ratio enabling a solidification front in the molten metal to occur that generally moves from the bottom surface to a top surface of the ingot wherein said at least two transversely extending depressions communicate with longitudinally extending sides of the ingot and are spaced from each other to receive a pair of fork lift blades entering the depressions from a direction perpendicular to one of the longitudinally extending sides for ease of handling.

14. The sow ingot of claim 13, wherein said longitudinally extending depression extends along the central longitudinal axis of the ingot, said transversely extending depressions extending generally perpendicular to the central depression and on opposite sides of a central transverse axis of the ingot.

15. In a sow ingot cast from a molten metal, the improvement comprising a bottom surface of the ingot including a longitudinally extending depression and a pair of transversely extending depressions configured to define an ingot bottom surface to volume ratio enabling a solidification front in the molten metal to occur that generally moves from the bottom surface to a top surface of the ingot to substantially entirely prevent formation of voids in the ingot and depression of the top surface, wherein said longitudinally extending depression extends along the central longitudinal axis of the ingot, wherein said pair of transversely extending depressions extend generally perpendicular to the central depression and on opposite sides of a central transverse axis of the ingot, wherein said pair of transversely extending depressions communicate with longitudinally extending sides of the ingot and are spaced from each other to receive a pair of fork lift tines entering the depressions from a direction perpendicular to one of the longitudinally extending sides for each of handling and wherein longitudinally extending bottom surface edges of the ingot extending contiguous with the longitudinally extending sides of the ingot define a pair of longitudinally extending raised depressions in the ingot bottom surface spaced from each other on opposite sides of the central longitudinal axis to establish a pair of raised side ledges in the ingot communicating with the transverses sides of the ingot and adapted to receive a pair of fork lift tines entering the raised depressions from a direction perpendicular to one of the transvserse ingot sides.

16. The ingot of claim 15, wherein said transversely extending depressions are equispaced from the central transverse axis.

17. The ingot of claim 16, wherein said central longitudinally extending depression extends substantially the entire length of ingot bottom surface.

18. The ingot of claim 17, wherein the height of the central longitudinally extending depression is at least about 25% of the ingot height.

19. The ingot of claim 18, wherein the central longitudinally extending depression extends at least 50% of the ingot length.

20. The ingot of claim 19, wherein the width of the raised side ledges is about at least 43% of the total ingot width.

21. The ingot of claim 20, wherein said length to width ratio of the ingot is approximately 1.6 to 1.0 and the height to length ratio of the ingot is not greater than about 0.2 to 1.0.

* * * * *